US011331943B2

(12) United States Patent
Livingston

(10) Patent No.: US 11,331,943 B2
(45) Date of Patent: May 17, 2022

(54) PAINTING BUCKET SYSTEM

(71) Applicant: Luke Livingston, Parker, CO (US)

(72) Inventor: Luke Livingston, Parker, CO (US)

( * ) Notice: Subject to any disclaimer, the term of this patent is extended or adjusted under 35 U.S.C. 154(b) by 62 days.

(21) Appl. No.: 16/520,413

(22) Filed: Jul. 24, 2019

(65) Prior Publication Data

US 2019/0344610 A1 Nov. 14, 2019

Related U.S. Application Data

(60) Provisional application No. 62/711,790, filed on Jul. 30, 2018.

(51) Int. Cl.

| | |
|---|---|
| ***B44D 3/12*** | (2006.01) |
| ***A46B 17/00*** | (2006.01) |
| ***A46B 17/02*** | (2006.01) |
| *B44D 3/00* | (2006.01) |
| *A46B 17/06* | (2006.01) |

(52) U.S. Cl.

CPC ..... *B44D 3/125* (2013.01); *A46B 17/06* (2013.01); *B44D 3/006* (2013.01)

(58) Field of Classification Search

CPC ..... A46B 17/06; A46B 17/02; B65D 3/123; B65D 3/006; B65D 3/121; B65D 3/12; B65D 3/125; B65D 3/126; B65D 1/36; B65D 25/10; Y10S 312/902; A47G 1/16; A47G 25/0607; A47G 29/08; F16B 45/00; B44D 3/123; B44D 3/125; B44D 3/12; B44D 3/126; B44D 3/006

USPC ..... 16/206; 24/369, 265 H; 211/65, 66; 248/111, 113, 690, 213.2, 303, 110, 112; 220/736, 495.02, 697, 570

See application file for complete search history.

(56) References Cited

U.S. PATENT DOCUMENTS

| | | | | | |
|---|---|---|---|---|---|
| 778,272 | A | * | 12/1904 | Roop | A47L 13/512 248/113 |
| 1,125,931 | A | * | 1/1915 | Arnest | B44D 3/123 248/113 |
| 1,176,009 | A | * | 3/1916 | Weimar | A47K 1/09 211/65 |
| 1,643,661 | A | * | 9/1927 | Kendall | A47J 43/287 248/113 |
| 1,949,912 | A | * | 3/1934 | Johnson | B44D 3/125 401/118 |
| 2,291,343 | A | * | 7/1942 | Millstone | B44D 3/123 248/110 |

(Continued)

*Primary Examiner* — Gideon R Weinerth

(74) *Attorney, Agent, or Firm* — Boudwin Intellectual Property; Daniel Boudwin

(57) ABSTRACT

A painting bucket system. The painting bucket system includes a first bucket. The first bucket includes a first bucket base. Additionally, the first bucket has at least one first bucket wall that extends upward from the first bucket base. The first bucket wall defines a first bucket opening at a top portion of the first bucket wall opposite of the first bucket base. A first bucket lip is defined around the first bucket opening. A plurality of hooks extends inward from the first bucket lip. The plurality of hooks can secure a plurality of paint brushes. The painting bucket system also includes a second bucket. The second bucket includes a second bucket base. A second bucket wall extends upward from the second bucket base. A plurality of rods extends upward from the second bucket base. The plurality of rods is designed to receive a plurality of paint roller pads.

11 Claims, 3 Drawing Sheets

(56) References Cited

U.S. PATENT DOCUMENTS 2,310,533 A * 2/1943 Lindell ..... B44D 3/123 211/65
2,340,660 A * 2/1944 Hansen ..... B44D 3/123 248/113
2,489,875 A * 11/1949 Embree ..... B44D 3/123 248/113
2,566,650 A * 9/1951 Anderson ..... B44D 3/125 211/65
2,704,931 A * 3/1955 Zelkowitz ..... B44D 3/006 68/213
2,755,052 A * 7/1956 Jennens ..... B44D 3/123 248/113
2,766,603 A * 10/1956 Zelkowitz ..... B44D 3/006 68/213
2,952,364 A * 9/1960 Jacobson ..... B44D 3/123 211/65
3,252,613 A * 5/1966 McGrath ..... B44D 3/12 220/23.87
3,432,875 A * 3/1969 Edelson ..... B44D 3/123 15/246
3,527,341 A * 9/1970 Peebles ..... B44D 3/125 206/209
4,852,833 A * 8/1989 Lockwood ..... B44D 3/123 248/110
4,860,891 A * 8/1989 Biggio ..... B44D 3/125 206/362
4,865,188 A * 9/1989 Custeau ..... B44D 3/006 206/209
4,865,282 A 9/1989 Yonkman et al.
5,016,773 A 5/1991 Lockwood
5,035,386 A * 7/1991 Tucker ..... B44D 3/123 248/110
5,097,965 A * 3/1992 Fehr ..... B44D 3/125 211/65
5,097,967 A * 3/1992 Sica ..... B44D 3/125 206/362
5,641,007 A * 6/1997 Falk ..... B44D 3/125 141/106
5,645,091 A * 7/1997 Hoeft ..... B08B 3/04 134/84
5,829,603 A * 11/1998 Martineau ..... A46B 17/06 211/66
5,996,952 A * 12/1999 Heywood ..... B44D 3/123 248/110
D431,701 S * 10/2000 Castillo ..... D32/54
6,193,080 B1 * 2/2001 Castillo ..... B44D 3/12 211/66
6,695,164 B1 * 2/2004 Chayer ..... B44D 3/123 206/15.2
D516,900 S * 3/2006 Hoernig ..... B44D 3/123 D8/367
7,118,078 B2 * 10/2006 Vukas ..... A46B 17/02 248/110
D542,536 S * 5/2007 Gialanella ..... B44D 3/12 D3/315
7,500,580 B2 3/2009 Hawkins
7,510,096 B2 * 3/2009 Wang ..... B65D 21/083 206/508
7,774,893 B2 * 8/2010 Keane ..... B44D 3/121 15/257.06
7,819,366 B2 * 10/2010 Paga, Jr. ..... B44D 3/123 248/110
D626,335 S * 11/2010 Sime ..... D3/313
8,100,272 B1 * 1/2012 Schaefer ..... A47B 81/02 211/65
8,286,790 B1 * 10/2012 McBryar ..... B44D 3/006 206/362
8,317,057 B2 * 11/2012 West ..... B44D 3/006 220/571.1
8,701,899 B2 * 4/2014 Paga ..... B44D 3/123 211/65
9,067,462 B1 * 6/2015 Pressler ..... B44D 3/127
9,102,193 B1 * 8/2015 Mahowald ..... B44D 3/127
10,457,091 B1 * 10/2019 Byker ..... B65D 25/10
2004/0261819 A1 * 12/2004 Farnoush ..... B44D 3/125 15/257.01
2005/0035131 A1 2/2005 Martinson
2005/0145757 A1 * 7/2005 Brown ..... A46B 17/02 248/213.2
2005/0161460 A1 7/2005 DePasquale et al.
2006/0278780 A1 * 12/2006 Kovall ..... B44D 3/123 248/213.2
2009/0146022 A1 * 6/2009 Paga, Jr. ..... B44D 3/123 220/736
2011/0108501 A1 * 5/2011 Ambrosen ..... B44D 3/125 211/65
2011/0147394 A1 6/2011 Thorp
2012/0175278 A1 * 7/2012 Stevens ..... B44D 3/123 206/373
2012/0240967 A1 * 9/2012 Krzycki ..... B44D 3/006 134/115 R
2013/0119003 A1 * 5/2013 Paga ..... A47K 1/09 211/65
2013/0276836 A1 * 10/2013 Fahy ..... A46B 17/06 134/25.1
2014/0102925 A1 * 4/2014 Jacobson ..... B25H 3/00 206/361
2015/0360505 A1 * 12/2015 Beck ..... B44D 3/123 211/65
2017/0311709 A1 * 11/2017 McInerney ..... A46B 17/02
2020/0305591 A1 * 10/2020 Byrne ..... A46D 3/00
2021/0237504 A1 * 8/2021 Turner ..... B44D 3/123

* cited by examiner

PAINTING BUCKET SYSTEM

CROSS REFERENCE TO RELATED APPLICATIONS

This application claims the benefit of U.S. Provisional Application No. 62/711,790 filed on Jul. 30, 2018. The above identified patent application is herein incorporated by reference in its entirety to provide continuity of disclosure.

BACKGROUND OF THE INVENTION

The present invention relates to a painting bucket system. More specifically, the present invention relates to a system for storing used painting supplies in an effective manner.

Painting projects are time consuming endeavors that may require the use of several painting tools to complete. For example, an individual may need to utilize a paint brush, or paint brushes, to paint corners or hard to reach areas. Additionally, an individual may need to utilize a paint roller, or paint rollers, to paint large flat surfaces, such as walls or ceilings. Once an individual has finished painting with a paint brush or a paint roller, that paint brush or paint roller must be washed so that it can be used again. Failing to adequately wash a paint brush or a paint roller will result in that paint brush or paint roller being unusable.

Once paint brushes and paint rollers are washed, they must be placed in a storage area to dry. It is important to make sure that the paint brushes and paint rollers will dry in an appropriate manner, otherwise the paint brushes and paint rollers may not be acceptable for future use. For example, laying paint brushes or paint rollers flat, while they still contain moisture, could result in the bristles or padding becoming hard or rough. This could make the paint brush or paint roller unusable. Furthermore, it is convenient for individuals, especially professionals, to store paint brushes and paint rollers in an organized manner. It can be difficult without dedicated devices and spaces to ensure proper organization and drying.

Therefore, there is a defined need amongst the known solutions for a system that allows for an individual to properly stored washed paint brushes and paint rollers.

SUMMARY OF THE INVENTION

In view of the foregoing disadvantages inherent in the known types of painting implement storage solutions now present in the prior art, the present invention provides a painting bucket system wherein the same can be utilized for providing convenience for the user when storing painting implements, such as paint brushes and paint rollers.

The present system comprises a first bucket. The first bucket includes a first bucket base. Additionally, the first bucket has at least one first bucket wall that extends upward from the first bucket base. The first bucket wall defines a first bucket opening at a top portion of the first bucket wall opposite of the first bucket base. A first bucket lip is defined around the first bucket opening. A plurality of hooks extends inward from the first bucket lip. The present system further comprises a second bucket. The second bucket includes a second bucket base. A second bucket wall extends upward from the second bucket base. A plurality of rods extends upward from the second bucket base. The plurality of rods is designed to receive a plurality of paint roller pads.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
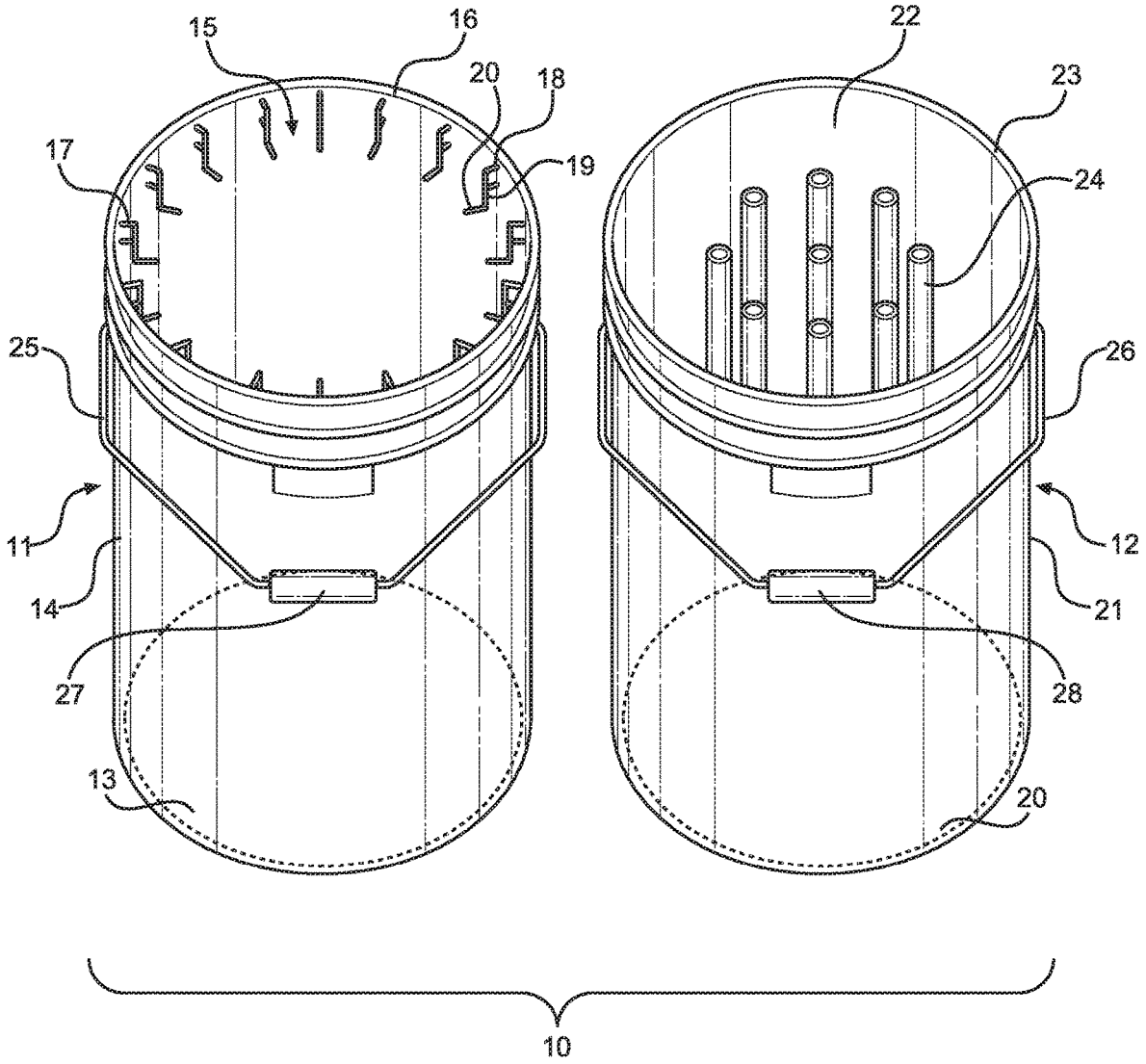
FIG. 1 shows a perspective view of an embodiment of the painting bucket system.

Reference is made herein to the attached drawings. Like reference numerals are used throughout the drawings to depict like or similar elements of the painting bucket system. The figures are intended for representative purposes only and should not be considered to be limiting in any respect.

Referring now to FIG. 1, there is shown a perspective view of an embodiment of the painting bucket system. In the illustrated embodiment, the painting bucket system 10 comprises a first bucket 11 and a second bucket 12. The first bucket 11 comprises a first bucket base 13 with at least one first bucket wall 14 extending upward therefrom. As such, a first bucket cavity 15 is formed. A first bucket opening is defined by the first bucket wall 14 opposite the first bucket base 13, such that access is provided to the first bucket cavity 15. A first bucket lip 16 is provided around the first bucket opening. In the illustrated embodiment, the first bucket lip 16 is of an identical diameter to the first bucket base 13. Additionally, in the illustrated embodiment, the first bucket base 13 is circular, thus defining the first bucket wall 14 as tubular. In alternate embodiments, the first bucket 11 may be of any desired shape, dimension or size.

In the illustrated embodiment, a plurality of hooks 17 extend inward from the first bucket lip 16. The plurality of hooks 17 are configured to allow an item, such as a paintbrush having an aperture disposed through the handle, to hang thereon. In the illustrated embodiment, each hook 17 of the plurality of hooks 17 comprises a pair of wall supports 18. An intermediate support 19 is perpendicularly affixed to both of the pair of wall supports 18 at a proximal end of the intermediate support 19. A hook support 20 is perpendicularly affixed to the intermediate support 19 at a distal end of the intermediate support, opposite of the pair of wall supports 18.

The second bucket 12 comprises a second bucket base 20 with at least one second bucket wall 21 extending upward therefrom. As such, a second bucket cavity 22 is formed. A second bucket opening is defined by the second bucket wall 21 opposite the second bucket base 20, such that access is provided to the second bucket cavity 22 therethrough. A second bucket lip 23 is provided around the second bucket opening. In the illustrated embodiment, the second bucket lip 23 is of an identical diameter to the second bucket base 20. Additionally, in the illustrated embodiment, the second bucket base 20 is circular, thus defining the second bucket wall 21 as tubular. In alternate embodiments, the second bucket 12 is of any suitable shape, dimension or size.

In the illustrated embodiment, the second bucket 12 comprises a plurality of rods 24. The plurality of rods 24 extend upward from the second bucket base 20 toward the second bucket lip 23, but do not extend above the second bucket wall 21. As such, the first bucket 11 can be placed on the second bucket 12 for storage. The plurality of rods 24, in the illustrated embodiment, are tubular and are each parallel to each other, such that they are configured to receive a paint roller. In one embodiment, as shown, each rod of the plurality of rods 24 is beveled at an end opposite of the second bucket base 20. As such, the risk of damage to the paint rollers being placed on the plurality of rods 24 is reduced.

In the illustrated embodiment, the first bucket 11 comprises a first bucket handle 25 and the second bucket 12 comprises a second bucket handle 26. Each bucket handle 25, 26 is rotatably affixed to the corresponding bucket lip 16, 23, such that rotational movement of the first bucket 11 and the second bucket 12 is enabled. Additionally, in the illustrated embodiment, the first bucket handle 25 comprises a first bucket handle sleeve 27 and the second bucket handle 26 comprises a second bucket handle sleeve 28. As such, the first bucket 11 and the second bucket 12 will each be easier and more comfortable to carry.

The first bucket 11 and the second bucket 12 may be of any size for a desired purpose. For example, in commercial settings, the first bucket 11 and the second bucket 12 would be of a larger size, such that larger paint rollers and larger paint brushes can be stored in the painting bucket system 10. Additionally, in the illustrated embodiment, the first bucket 11 and the second bucket 12 are identical in size. As such, the first bucket 11 can be placed on top of the second bucket 12 for storage, such that the first bucket base 13 will rest on the plurality of rods 24 of the second bucket 12. Alternatively, the second bucket 12 could be placed on top of the first bucket 11 for storage, such that the second bucket base 20 can rest on the plurality of hooks 17. The first bucket 11 and the second bucket 12 can be made of any durable, washable material. For example, in one embodiment, the first bucket 11 and the second bucket 12 are made of plastic.

Figure 2:
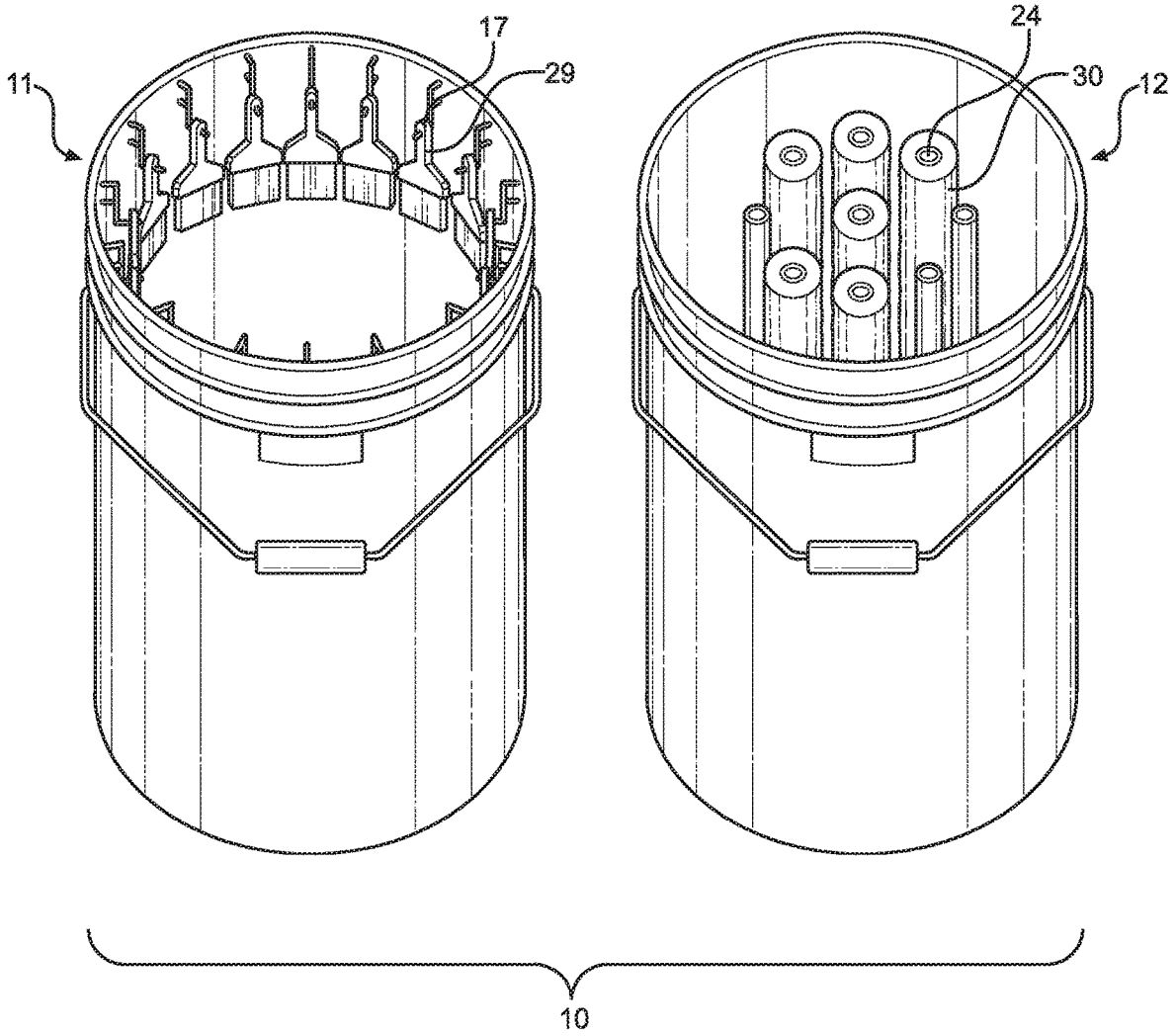
FIG. 2 shows a perspective view of an embodiment of the painting bucket system in use.

Referring now to FIG. 2, there is shown a perspective view of an embodiment of the painting bucket system in use. In use, the painting bucket system 10 is utilized to store painting supplies. Specifically, the painting bucket system 10 can store paint brushes 29 in the first bucket 11 and can store paint rollers 30 in the second bucket 12. Regarding the first bucket 11, the plurality of hooks 17 are disposed at a top portion of the first bucket, such that when the paint brushes 29 are hung on the plurality of hooks 17, the water, paint, paint thinner or other fluids will drip and/or flow downward, by the force of gravity, towards the first bucket base.

The second bucket 12 is configured to store paint rollers 30. Standard paint rollers 30 comprise a centralized cavity that is dimensioned to receive a paint rolling device. As such, each rod of the plurality of rods 24 can receive a paint roller 30 by extending through the centralized cavity of the paint roller.

Figure 3:
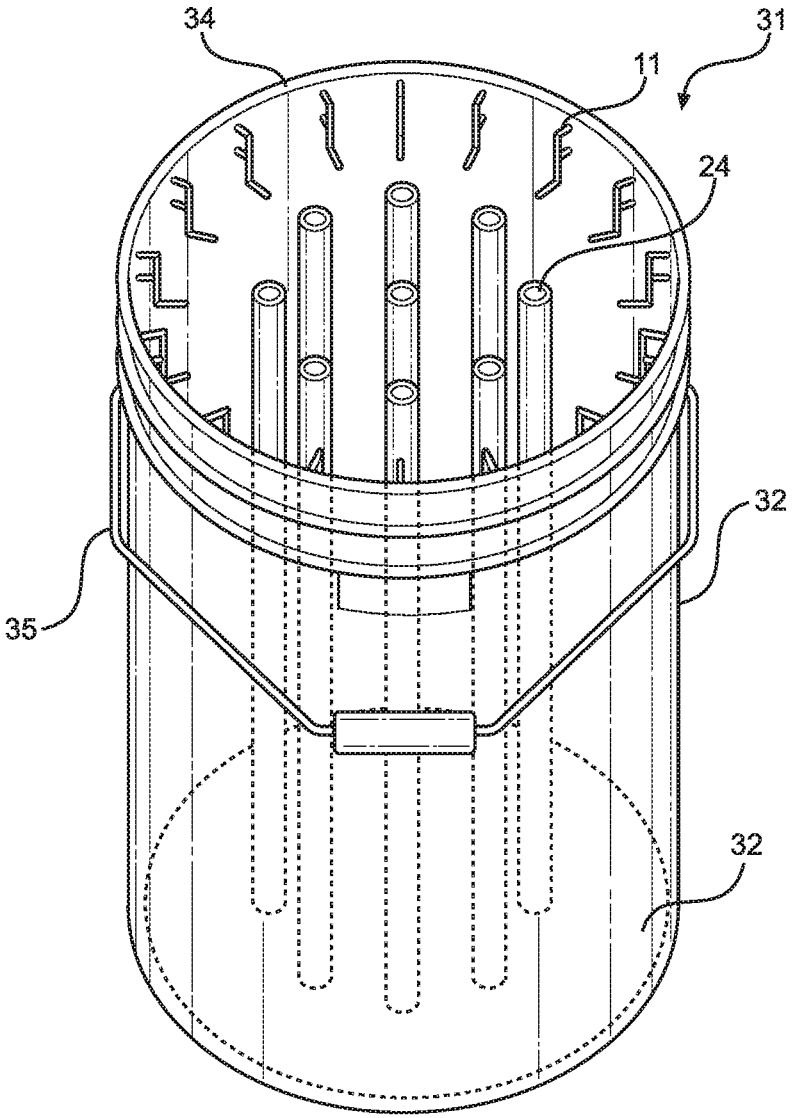
FIG. 3 shows a perspective view of an alternate embodiment of the painting bucket system.

Referring now to FIG. 3, there is shown a perspective view of an alternate embodiment of the painting bucket system. In an alternate embodiment, the painting bucket system comprises a bucket 31. The bucket 31 comprises a base 32 having at least one wall 33 extending upward therefrom. The wall 33 defines an opening at a top portion of the wall 33 opposite the base 32. A lip 34 is defined around the opening, such that the interior cavity of the bucket 31 is accessible therethrough. A plurality of hooks 17 is defined around the lip and extending inward, such that a plurality of paint brushes can be stored thereon. Furthermore, a plurality of rods 24 extend upward from the base 32, such that a plurality of paint rollers can be stored thereon. In the illustrated embodiment, both paint brushes and paint rollers can be stored on the alternative painting bucket system.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A painting bucket system, comprising:

a first bucket, having a first bucket base with at least one first bucket wall extending upward therefrom;

the first bucket wall defining a first bucket opening at a top portion of the first bucket wall opposite of the first bucket base;

a first bucket lip defined around the first bucket opening;

a plurality of hooks disposed at a top portion of the first bucket and integral with the first bucket wall;

the plurality of hooks extending inward from the first bucket lip;

each hook of the plurality of hooks comprising a pair of wall supports extending from the first bucket wall, an intermediate support disposed on the pair of wall supports opposing the first bucket wall and a hook support perpendicularly affixed to the intermediate support at a distal end of the intermediate support;

a second bucket, having a second bucket base with at least one second bucket wall extending upward therefrom;

a plurality of rods extending orthogonally upward from the second bucket base.

2. The painting bucket system of claim 1, wherein the first bucket comprises a first bucket handle.

3. The painting bucket system of claim 1, wherein the second bucket comprises a second bucket handle.

4. The painting bucket system of claim 1, wherein the first bucket comprises a first bucket base that is circular and a first bucket wall that is tubular.

5. The painting bucket system of claim 1, wherein the second bucket comprises a second bucket base that is circular and a second bucket wall that is tubular.

6. The painting bucket system of claim 1, wherein the first bucket and the second bucket are identical in size.

7. The painting bucket system of claim 1, wherein the first bucket and the second bucket are made of plastic.

8. A painting bucket system, comprising:

a bucket having a base with at least one wall extending upward therefrom;

the wall defining an opening at a top portion of the wall opposite of the base;

a lip defined around the opening;

a plurality of hooks disposed at a top portion of the bucket and integral with the bucket;

the plurality of hooks extending inward from the lip;

each hook of the plurality of hooks comprising a pair of wall supports extending from the first bucket wall, an intermediate support disposed on the pair of wall supports opposing the first bucket wall and a hook support perpendicularly affixed to the intermediate support at a distal end of the intermediate support;

a plurality of rods extending upward from the base.

9. The painting bucket system of claim 8, wherein the bucket comprises a handle.

10. The painting bucket system of claim 8, wherein the bucket comprises a base that is circular and a wall that is tubular.

11. The painting bucket system of claim 8, wherein the bucket is made of plastic.

* * * * *